US009636594B2

(12) United States Patent
Rehkemper et al.

(10) Patent No.: US 9,636,594 B2
(45) Date of Patent: May 2, 2017

(54) SYSTEM FOR CONTROLLED DISTRIBUTION OF LIGHT IN TOY CHARACTERS

(71) Applicant: Rehco, LLC, Chicago, IL (US)

(72) Inventors: Steven Rehkemper, Chicago, IL (US); Jeffrey Rehkemper, Chicago, IL (US); Jackson Wilson, Evanston, IL (US)

(73) Assignee: Rehco, LLC, Chicago, IL (US)

( * ) Notice: Subject to any disclaimer, the term of this patent is extended or adjusted under 35 U.S.C. 154(b) by 0 days.

(21) Appl. No.: 14/502,051

(22) Filed: Sep. 30, 2014

(65) Prior Publication Data

US 2015/0093958 A1 Apr. 2, 2015

Related U.S. Application Data

(60) Provisional application No. 61/885,179, filed on Oct. 1, 2013.

(51) Int. Cl.
*A63H 3/38* (2006.01)
*A63H 3/00* (2006.01)

(52) U.S. Cl.
CPC ..... *A63H 3/38* (2013.01); *A63H 3/006* (2013.01)

(58) Field of Classification Search
CPC ..... A63H 3/38
USPC ..... 446/392
See application file for complete search history.

(56) References Cited

U.S. PATENT DOCUMENTS 1,981,333 A * 11/1934 Schavoir ..... A63H 3/38 446/267
2,619,772 A * 12/1952 Dikszas ..... A63H 3/006 40/416
2,671,161 A * 3/1954 Johnson ..... A63J 19/00 362/153
2,904,928 A * 9/1959 Bashover ..... A63H 3/40 446/342
2,914,772 A * 12/1959 Lemelson ..... A41G 7/00 2/206
3,423,874 A * 1/1969 Crosman ..... A63H 3/40 446/132

(Continued)

FOREIGN PATENT DOCUMENTS

EP 0441566 A1 * 8/1991 ..... A63H 3/006

OTHER PUBLICATIONS

U.S. Appl. No. 14/502,051, Dolores Collins.*

*Primary Examiner* — Aarti B Berdichevsky
*Assistant Examiner* — Dolores Collins
(74) *Attorney, Agent, or Firm* — Brooks Kushman P.C.

(57) ABSTRACT

A toy character is provided including a body supporting an eye assembly. The eye assembly may include a base, a plate and three or more segments connecting the base and plate. The three or more segments may define two cavities therebetween. Two light emitting sources may each be arranged with the base and oriented within their respective cavities such that activation of the light emitting sources directs light output toward the plate. The plate may include two regions corresponding to the two cavities which may illuminate when the respective light emitting sources are activated. The toy character may include two eye assemblies. The toy character may include a control system configured to direct operation of the light emitting sources. The control system may direct illumination sequences according to software instructions included within the control system.

19 Claims, 4 Drawing Sheets

(56) References Cited

U.S. PATENT DOCUMENTS 4,644,454 A * 2/1987 Herst ..... F21V 5/02 362/224
4,655,721 A * 4/1987 Loomis ..... A63H 3/006 446/219
4,828,531 A * 5/1989 Kuhn ..... A63H 3/40 446/341
5,267,886 A * 12/1993 Wood ..... A63H 3/006 446/175
5,697,829 A * 12/1997 Chainani ..... A63H 17/395 318/568.12
5,782,669 A * 7/1998 Hornsby ..... A63H 3/40 446/342
6,188,181 B1 * 2/2001 Sinha ..... H05B 37/0254 315/293
6,575,802 B2 * 6/2003 Yim ..... B25J 9/1617 446/484
6,729,934 B1 * 5/2004 Driscoll ..... A63H 3/28 340/10.41
6,875,074 B1 * 4/2005 Morris ..... A63H 3/365 446/321
7,338,340 B2 * 3/2008 Poesch ..... A63H 3/16 446/100
7,485,025 B2 * 2/2009 Schnuckle ..... A63H 3/38 446/343
7,566,258 B2 * 7/2009 Connolly ..... A63H 3/006 446/485
7,641,535 B2 * 1/2010 Maddocks ..... A63H 3/38 446/342
7,659,674 B2 * 2/2010 Mueller ..... H05B 33/0857 315/291
8,052,502 B2 * 11/2011 Connolly ..... A63H 3/006 446/389
8,298,037 B2 * 10/2012 Sip ..... A63H 3/40 446/343
8,353,737 B2 * 1/2013 Sofman ..... A63H 17/40 446/454
8,651,916 B2 * 2/2014 Irmler ..... A63H 3/40 446/219
8,747,182 B2 * 6/2014 Sofman ..... A63H 17/40 446/446
8,845,385 B2 * 9/2014 Sofman ..... A63H 17/40 446/454
8,951,092 B2 * 2/2015 Sofman ..... A63H 17/40 446/410
8,951,093 B2 * 2/2015 Sofman ..... A63H 17/40 446/410
2004/0141321 A1 * 7/2004 Dowling ..... A63H 33/22 362/276
2007/0173171 A1 * 7/2007 Pal Benedek ..... A63H 17/36 446/175
2010/0311305 A1 * 12/2010 Sip ..... A63H 3/40 446/343
2011/0175553 A1 * 7/2011 Sampsell ..... H05B 37/0245 315/312

* cited by examiner 2
3a
3b
3c
4
5a
5b
5c
6
7a
7b
7c 100
102a
102b
102c 110
112a
112b
112c
112a
112b
112c 120
122a
122b
122c
122a
122b
122c 130
132a
132b
132c
132a
132b
132c

SYSTEM FOR CONTROLLED DISTRIBUTION OF LIGHT IN TOY CHARACTERS

CROSS-REFERENCE TO RELATED APPLICATIONS

This application claims the benefit of U.S. provisional Application No. 61/885,179 filed Oct. 1, 2013, the disclosure of which is incorporated in its entirety by reference herein.

TECHNICAL FIELD

This disclosure relates to a system for controlling distribution of light in toy characters.

SUMMARY

A toy character may include a body supporting an assembly. The assembly includes a base, a plate and three or more segments connecting the base and plate. The three or more segments may define two cavities therebetween. Two light emitting sources may each be arranged with the base and oriented within their respective cavities such that activation of the light emitting sources directs light output toward the plate. The plate includes two regions corresponding to the two cavities which may illuminate when the respective light emitting sources are activated. The toy character may include two assemblies. The toy character may include a control system configured to direct operation of the light emitting sources. The control system may include a processor with a memory. The processor may be in communication with two drivers to direct output of the light emitting sources. The memory may include software instructions configured to activate one or more illumination sequences of the light emitting sources. The illumination sequence may be a blinking sequence. The light emitting sources may be light emitting diodes. A graphic layer may be stylized as an eye and secured to the plate. A reflecting sheet may be secured to the eye graphic. A sensor may be included on the body of the toy character to trigger activation of the illumination sequences.

A toy character includes a body and at least one eye assembly secured to the body. Each of the at least one eye assembly includes a frame with receptacles, an eye plate upon the frame, and a plurality of light sources each received in one of the receptacles and oriented to illuminate a region of at least the eye plate. The toy character also includes a control system in electrical communication with the light sources to operate the light sources to simulate animation of an eye. The toy character may also include a graphic layer with indicia indicative of an eye design and a reflective sheet arranged with each eye plate to limit or prevent visibility into the receptacles. The frame may include a plurality of segments to further define the receptacles and to support the eye plate. Each of the plurality of segments may be formed with a thickness such that a portion of the eye plate adjacent the plurality of segments receives a sufficient amount of light to prevent visibility of the plurality of segments. The at least one eye assembly may have two receptacles and two light sources. The eye plate may have two regions corresponding to the two light sources. The control system may include a method to operate the two light sources in a blinking sequence displayed on the two regions which includes the steps of activating the two light sources, deactivating one of the two light sources, deactivating another of the two light sources, activating the another of the two light sources, and activating the one of the two light sources. The toy character may also include a plurality of appendages secured to the body for movement relative thereto, and a plurality of actuators oriented in the body, each in cooperation with one of the plurality of appendages. The control system may be in electrical communication with the plurality of actuators, and may be further configured to operate the actuators to actuate the appendages. The toy character may be an animal, doll, or vehicle. The toy character may also include a sensor in electrical communication with the control system. The control system may be further configured to receive an input signal from the sensor, and to activate one or more illumination sequences in response to the input signal from the sensor.

An eye assembly for a toy character includes an eye housing with a cavity and an opening, at least one segment disposed in the cavity to define at least two receptacles, a substrate secured to the opening, a graphic layer, and at least two light sources. The graphic layer includes indicia indicative of an eye displaced upon the substrate. The at least two light sources are each located in one of the at least two receptacles and oriented to output light toward the substrate such that incremental illumination of the at least two light sources generates a display associated with opening or closing of an eyelid. The eye assembly may include a control system in electrical communication with the at least two light sources to activate the light sources to simulate animation of an eye. The control system may be further configured to adjust a brightness level of the at least two light sources. The eye assembly may also include a sensor in electrical communication with the control system when triggered. The control system may be further configured to receive an input signal from the sensor, and to activate one or more illumination sequences in response to the input signal from the sensor. The at least two lights sources may be further defined as an upper light source and a lower light source. The control system may include a method to operate the incremental illumination of the upper light source and the lower light source including the steps of activating the upper and lower light sources, deactivating the upper light source, deactivating the lower light source, activating the lower light source, and activating the upper light source. The eye assembly may further include a reflective sheet arranged with each substrate to limit or prevent visibility into the receptacles. The reflective sheet may be of a material having light diffusing characteristics.

A toy character includes a body and first and second eye assemblies secured to the body. Each of the first and second eye assemblies includes a frame defining two cavities, an eye plate upon the frame and having first and second regions, and first and second light sources. Each of the first and second light sources are received in one of the two cavities and oriented to illuminate at least the respective first and second regions. The toy character also includes a control system in electrical communication with the first and second light sources. The control system includes a method to operate the first and second light sources in a blinking sequence displayed on the first and second regions which includes activating the first and second light sources of each of the first and second assemblies, deactivating the first light sources of each of the first and second assemblies, deactivating the second light sources of each of the first and second assemblies, activating the second light sources of each of the first and second assemblies, and activating the first light sources of each of the first and second assemblies. Each of the first and second assemblies may further include a graphic layer upon the eye plate with indicia indicative of an eye design. The toy character may also include a plurality of appendages secured to the body for movement relative thereto and a plurality of actuators oriented in the body, each in cooperation with one of the plurality of appendages. The control system may be in electrical communication with the plurality of actuators, and may be further configured to operate the actuators to actuate the appendages. The toy character may also include a sensor in electrical communication with the control system. The control system may be further configured to receive an input signal from the sensor, and to activate one or more illumination sequences of the first and second light sources in response to the input signal from the sensor. Each frame of the first and second eye assemblies may further include a plurality of segments formed with a thickness such that a portion of the respective eye plate adjacent the plurality of segments receives a sufficient amount of light to prevent visibility of the plurality of segments.

DETAILED DESCRIPTION

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the present disclosure. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Toy characters may include mechanical and electrical components to animate the characters and prompt interaction with users. These interactions may include various play patterns to engage the users such as playing and/or caring for a pet or doll. A control system may direct operation of the mechanical and electrical components to further enhance the interactions.

Figures 1A, 1B, 2A, 2B, 2C, 2D, 2E, 2F, 2G:
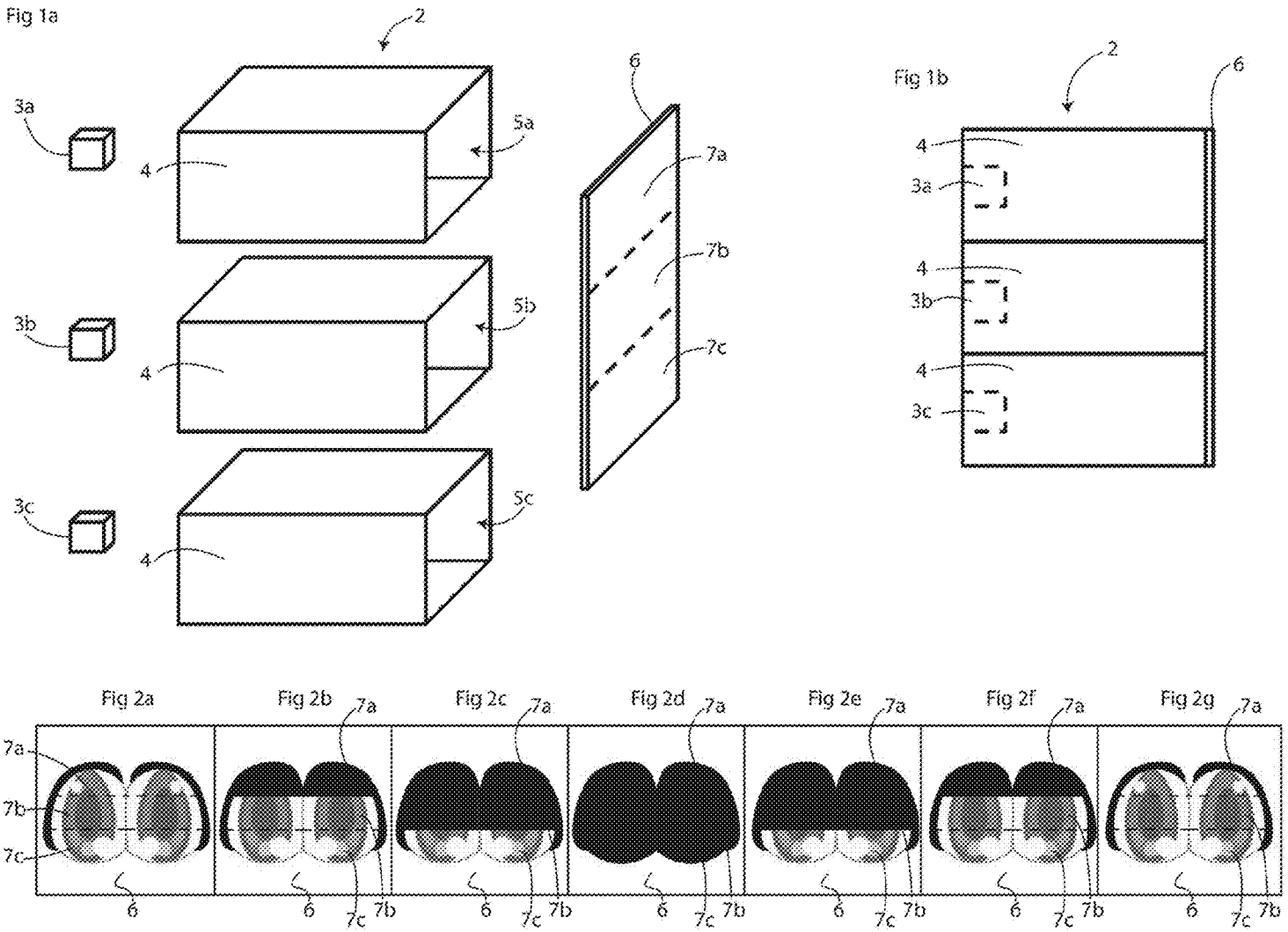
FIG. 1*a* is a perspective, exploded view of an example of an eye assembly.
FIG. 1*b* is a side view of the eye assembly of FIG. 1*a*.
FIGS. 2*a* through 2*g* illustrate one example of a blinking sequence for a pair of eyes of a toy character.

FIGS. 1*a* and 1*b* show an illustrative example of an assembly 2 which may operate with a control system to animate a portion of a toy character, such as a set of eyes. In this example, the assembly 2 may illuminate regions of the set of eyes in one or more sequences to simulate eye movements as shown in FIGS. 2*a* through 2*g*. The assembly 2 may be used with a variety of different toy characters as further described herein. Assembly 2 may include light sources such as a light 3*a*, a light 3*b*, and a light 3*c* (which may be collectively referred to as lights 3 herein). In this example, housings 4 are shown as three blocks in FIGS. 1*a* and 1*b* for illustrative purposes, though the forms of the housings 4 may vary. Sides of the housing 4 may include segments and/or walls to define a cavity 5*a*, cavity 5*b*, and cavity 5*c* (which may be collectively referred to as cavities 5 herein) which may open to a plate 6. The plate 6 may be secured to one end of the housings 4 and opposite the lights 3. The plate 6 may be transparent and/or include a graphic, such as an eye design with three regions. The lights 3 may be arranged and oriented with cavities 5 such that light output from the lights 3 is directed toward the plate 6. The housings 4 may be opaque and assist in directing the light output toward a region of the plate 6 corresponding to the respective cavity. For example, the plate may include a region 7*a*, region 7*b*, and region 7*c* (which may be collectively referred to as regions 7 herein).

The assembly 2 may include a capability to selectively control distribution of light from the lights 3 to illuminate the regions 7 in one or more sequences. In this example, plate 6 may include an eye graphic separated into region 7*a*, region 7*b*, and region 7*c* (shown in FIGS. 2*a* through 2*g*). While three regions are shown in this example, other examples may include two or more regions and be positioned on various portions of toy characters as further described herein. The regions 7 may be illuminated at various times and/or in various combinations to animate the eye graphic of plate 6. One example may include a blinking sequence as illustrated in FIGS. 2*a* through 2*g*. In FIG. 2*a* the regions are illuminated in an eyes open configuration. In FIG. 2*b* the region 7*b* and region 7*c* are shown illuminated. FIG. 2*c* shows the third region 30 illuminated and in FIG. 2*d* all three regions are not illuminated in an eyes closed configuration. FIGS. 2*e* through FIG. 2*g* illustrate the regions illuminating in sequence to return to the eyes open configuration in which the regions 7 are once again illuminated. As mentioned above, the regions 7 may be illuminated in multiple sequences and may be used with a variety of toy characters and structures.

Figure 3:
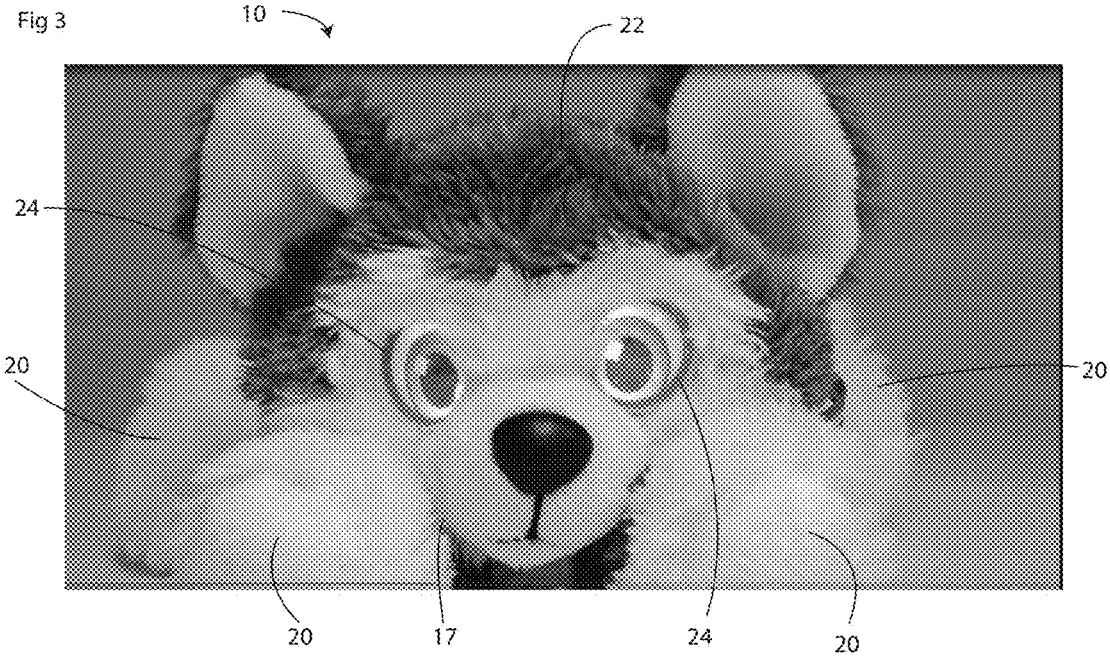
FIG. 3 is a front perspective view of an example of a toy character.
Figure 4:
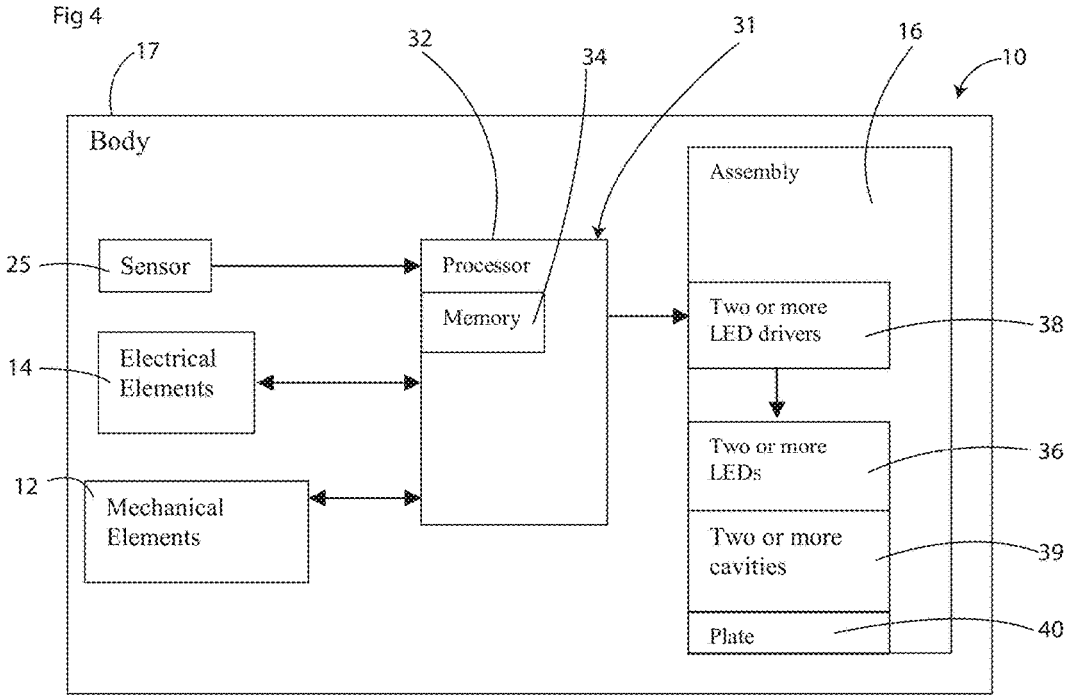
FIG. 4 is a block diagram of an example of another toy character.
Figure 5A:
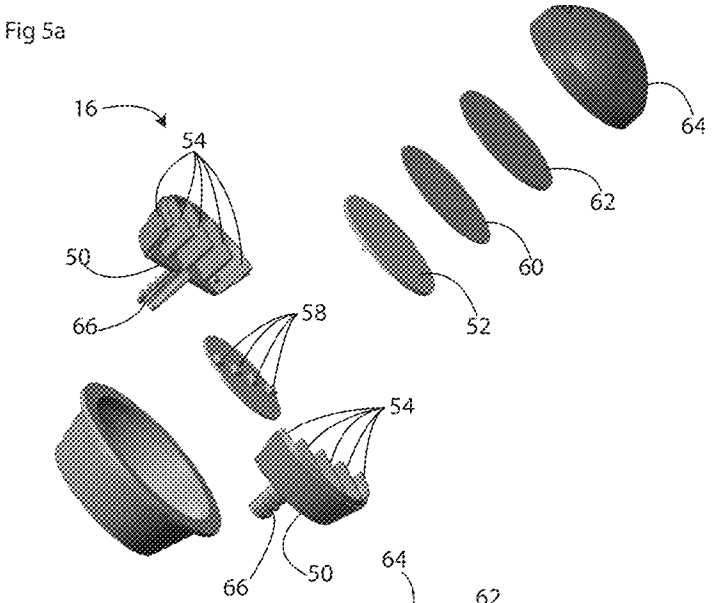
FIG. 5*a* is an exploded, perspective view of another eye assembly.
Figure 5B:
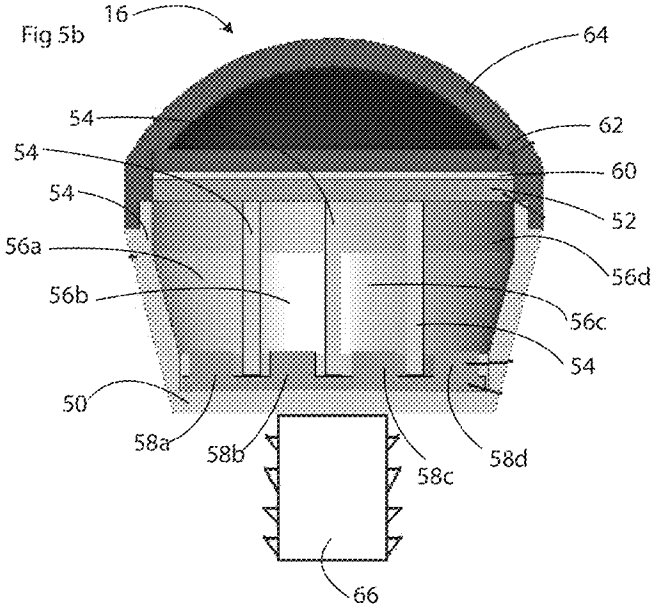
FIG. 5*b* is a side view, in cross-section, of the eye assembly of FIG. 5*a*.
Figure 5D:
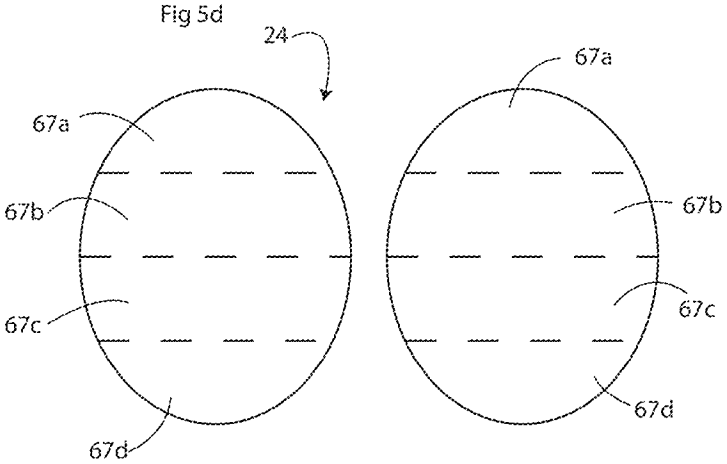
FIG. 5*d* is a front view of two plates of two of the eye assemblies of FIG. 5*a*.
Figure 5C:
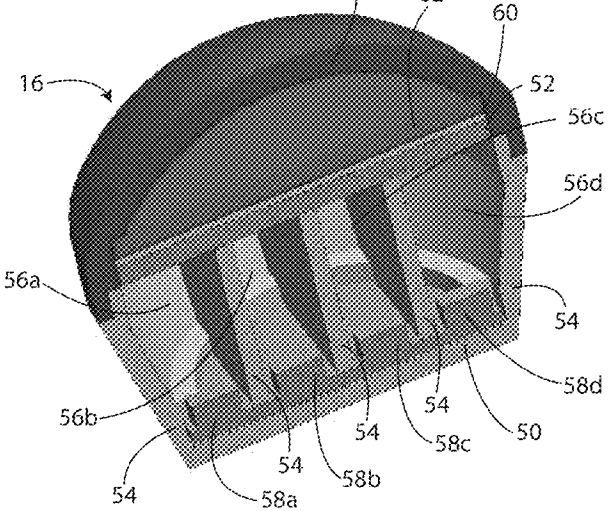
FIG. 5*c* is a perspective view, in cross-section, of the eye assembly of FIG. 5*a*.

For example and now referring to FIGS. 3 and 4, an illustrative toy character 10 is shown which may include components to animate the toy character 10 and prompt interaction with users. In this example, the toy character 10 is in the form of a puppy. However, the toy character may take on several other forms which may include animals, vehicles, or dolls to name a few. A variety of forms may be used to incorporate the components of the toy character 10 as described herein. The toy character 10 may include mechanical elements 12, electrical elements 14, and an assembly 16 housed within a body 17. The mechanical elements 12 may be one or more parts which move different portions of the toy character 10 such as legs 20 and a head 22. The electrical elements 14 may, for example, distribute power to the mechanical elements 12 from a power source (not shown) and may assist in directing operations of the toy character 10. The toy character 10 may include two assemblies 16 to accommodate a set of eyes 24 which are spaced apart.

The assembly 16 may be in communication with a control system 31 having a processor 32 with a memory 34. The processor 32 may direct operations of the toy character 10 including operation of the mechanical elements 12, the electrical elements 14, and the assembly 16. The memory 34 may store software operating instructions to assist in directing operations of the toy character 10. For example, the software instructions may initiate one or more illumination sequences as described further below. A sensor 25 may also be in communication with the processor 32 such that the sensor may trigger and send a notification signal to the processor 32 to activate the software instructions. In one example which may include two or more light sources, the light source may be a light emitting diode ("LED") such as LEDs 36. The processor 32 may send one or more control signals to LED drivers 38 to activate the LEDs 36 according to the software instructions. The LEDs 36 may be arranged with two or more cavities 39 and oriented such that the light output of LEDs 36 is directed toward a plate 40 secured to segments, such as walls, which may define the cavities 39. Plate 40 may be transparent such that light output of LEDs 36 may be seen at the plate 40. The plate 40 may also include a graphic layer such as an eye design. As described above, the LEDs 36 may be illuminated in different sequences to simulate a blinking sequence of light from the cavities 39. Another example of an illumination sequence may include a winking sequence. Variable timing scenarios may also be used to provide additional illumination sequences such as a rapid blinking sequence. The software instructions may also direct the LEDs 36 to illuminate at different brightness levels.

FIGS. 5*a* through 5*d* include one example of an assembly 16 structure for each of the eyes 24 of toy character 10. The assembly 16 may include a base 50, a plate 52 and one or more segments 54 connecting the base 50 and plate 52. The base 50, plate 52 and segments 54 may define cavity 56*a*, 56*b*, 56*c* and 56*d* (which may collectively be referred to as cavities 56 herein). The thickness of the segments 54 may vary, however a preferred thickness may be such that a portion of the plate 52 adjacent to the segments 54 receives enough light to prevent a black line and/or dark line thereon. Segments 54 may include a thickness similar to a piece of paper and made of an opaque material. Alternatively and/or optionally, the segments 54 may have a larger thickness if, for example, it is desired to include additional structural rigidity of the assembly 16. Assembly 16 may include LEDs 58*a*, 58*b*, 58*c*, and 58*d* (which may be collectively referred to as LEDs 58 herein) in place of the two or more LEDs 36. The LEDs 58 may be supported by the base 50 and arranged within their respective cavities 56 and oriented such that light output is directed toward plate 52. A distance between the LEDs 58 and plate 52 may vary according to the type of LED and available space within the toy character 10. For example, the LEDs 58 may be spaced between one quarter of an inch and three quarters of an inch from the plate 52. If less space is available, an LED with a wider beam may be used. The cavities 56 may correspond to four respective regions of a graphic layer 60 such as region 67*a*, region 67*b*, region 67*c*, and region 67*d* (which may be collectively referred to as regions 67 herein). The regions 67 may be illuminated according to illumination sequences to provide animation of the eyes 24. A control system such as control system 31 may be in communication with the LEDs 58 to direct operations including the illumination sequences.

The graphic layer 60 may be arranged with the plate 52. For example, the graphic layer 60 may be styled as an eye and secured to the plate 52. Eyes 24 include one example of a graphic layer 60 as shown in FIG. 3. Optionally and/or alternatively, the graphic layer 60 may be arranged with the segments 54 instead of the plate 52. A reflecting sheet 62 may be arranged with the graphic layer 60. The reflecting sheet 62 may have characteristics similar to a two way mirror such that visibility into the cavities 56 is limited or prevented. A shell 64 may be arranged with the assembly 16 to protect adjacent assembly 16 components. The assembly 16 may be supported by the body 17 and secured thereto. For example, a boss 66 may fasten the assembly 16 to the head 22.

Figures 6A, 6B, 6C, 6D:
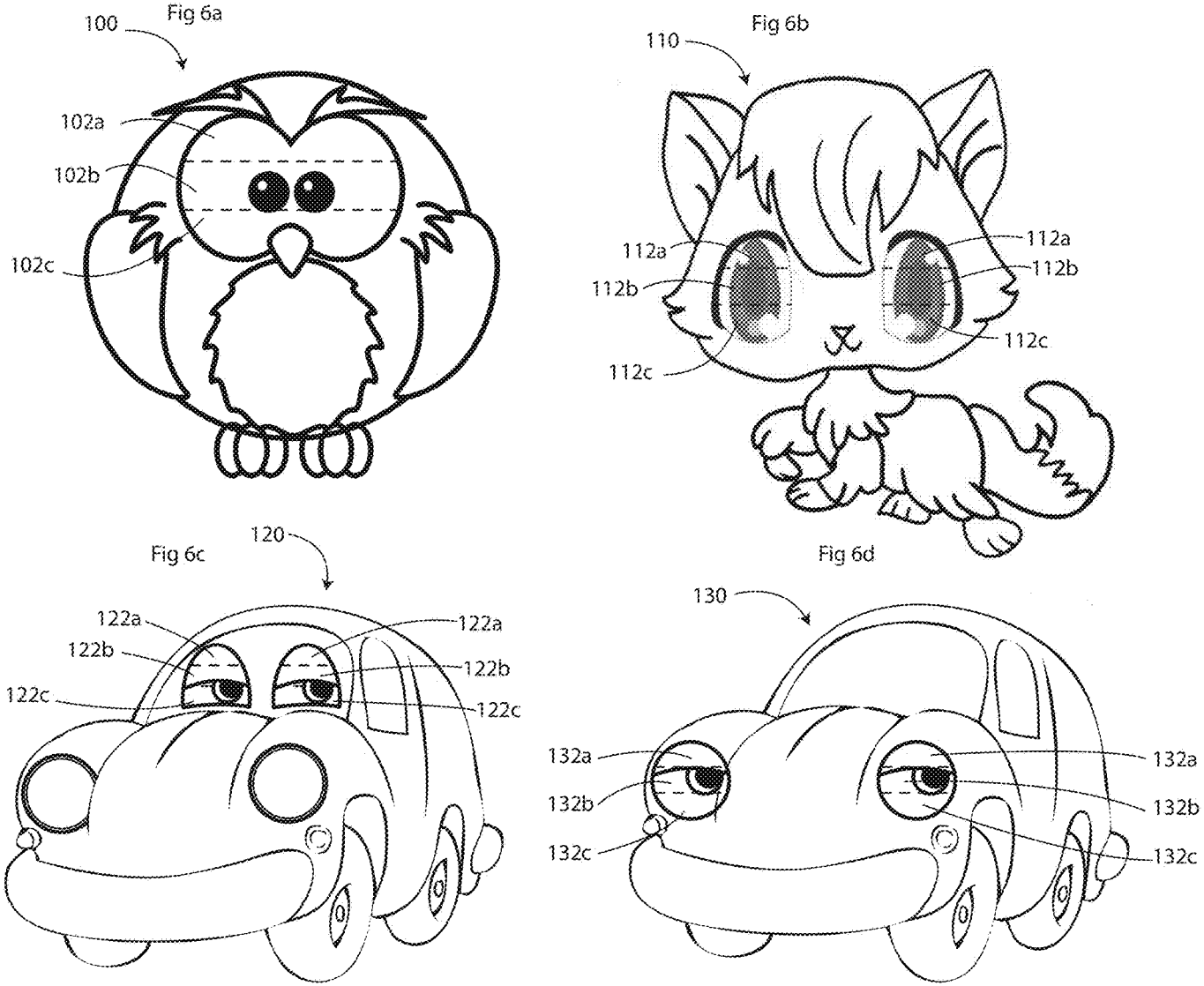
FIG. 6*a* through 6*d* are examples of toy characters shown with examples of pairs of eye assemblies.

As mentioned above, the toy character 10 may be available in different forms. FIG. 6*a* shows an embodiment in which a toy character 100 is styled as an owl. The toy character 100 may include a control system (not shown) in communication with eyes 102. Eyes 102 may include three regions 102*a*, 102*b*, and 102*c* which may be illuminated to animate the eyes 102 in different sequences as described above. FIG. 6*b* shows an embodiment in which a toy character 110 is styled as a cat. The toy character 110 may include a control system (not shown) in communication with eyes 112. Eyes 112 may include three regions 112*a*, 112*b*, and 112*c* which may be illuminated to animate the eyes 112 in different sequences as described above. FIG. 6*c* shows an embodiment in which a toy character 120 is styled as a car. The toy character 120 may include a control system (not shown) in communication with eyes 122 located on a windshield of the toy character 120. Eyes 122 may include three regions 122*a*, 122*b*, and 122*c* which may be illuminated to animate the eyes 122 in different sequences as described above. FIG. 6*d* shows an embodiment in which a toy character 130 is styled as a car. The toy character 130 may include a control system (not shown) in communication with eyes 132 located on headlights of the toy character 130. Eyes 132 may include three regions 132*a*, 132*b*, and 132*c* which may be illuminated to animate the eyes 132 in different sequences as described above.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the disclosure that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and can be desirable for particular applications.

What is claimed is:

1. A toy character comprising:

a body;

at least one eye assembly secured to the body, each at least one eye assembly comprising:

a frame, including a plurality of segments defining receptacles therebetween;

an eye plate upon the frame, and including at least two regions, each region corresponding to one of the receptacles;

a plurality of light sources each received in one of the receptacles and oriented to separately illuminate one of the at least two regions of the eye plate; and a control system in electrical communication with the light sources to operate the light sources to simulate animation of an eye.

2. The toy character of claim 1, further comprising:

a graphic layer with indicia indicative of an eye design; and a reflective sheet arranged with each eye plate to limit or prevent visibility into the receptacles.

3. The toy character of claim 1, wherein each of the plurality of segments is formed with a thickness such that a portion of the eye plate adjacent the plurality of segments receives a sufficient amount of light to prevent visibility of the plurality of segments.

4. The toy character of claim 1, wherein the at least one eye assembly has two receptacles and two light sources, and wherein the eye plate has two regions corresponding to the two light sources, and wherein the control system has a method to operate the two light sources in a blinking sequence displayed on the two regions comprising:

activating the two light sources;

deactivating one of the two light sources;

deactivating another of the two light sources;

activating the another of the two light sources; and activating the one of the two light sources.

5. The toy character of claim 1, further comprising:

a plurality of appendages secured to the body for movement relative thereto; and a plurality of actuators oriented in the body, each in cooperation with one of the plurality of appendages, wherein the control system is in electrical communication with the plurality of actuators, and is further configured to operate the actuators to actuate the appendages.

6. The toy character of claim 1, wherein the toy character is an animal, doll, or vehicle.

7. The toy character of claim 1, further comprising a sensor in electrical communication with the control system, and wherein the control system is further configured to receive an input signal from the sensor, and to activate one or more illumination sequences in response to the input signal from the sensor.

8. An eye assembly for a toy character comprising:

an eye housing with a cavity and an opening;

at least one segment disposed in the cavity to define at least two receptacles;

a substrate secured to the opening;

a graphic layer with indicia indicative of an eye displaced upon the substrate; and at least two light sources, each located in one of the at least two receptacles and oriented to output light toward the substrate such that separate illumination of each of the at least two light sources generates a display associated with stages of opening or closing an eyelid including a state in which the eyelid is partially closed.

9. The eye assembly of claim 8, further comprising a control system in electrical communication with the at least two light sources to activate the light sources to simulate animation of an eye.

10. The eye assembly of claim 9, wherein the control system is further configured to adjust a brightness level of the at least two light sources.

11. The eye assembly of claim 9, further comprising a sensor in electrical communication with the control system when triggered, wherein the control system is further configured to receive an input signal from the sensor, and to activate one or more illumination sequences in response to the input signal from the sensor.

12. The eye assembly of claim 9, wherein the at least two lights sources are further defined as an upper light source and a lower light source, and wherein the control system has a method to operate the incremental illumination of the upper light source and the lower light source comprising:

activating the upper and lower light sources;

deactivating the upper light source;

deactivating the lower light source;

activating the lower light source; and activating the upper light source.

13. The eye assembly of claim 8, further comprising a reflective sheet arranged with each substrate to limit or prevent visibility into the receptacles.

14. The eye assembly of claim 13, wherein the reflective sheet is of a material having light diffusing characteristics.

15. A toy character comprising:

a body;

first and second eye assemblies secured to the body and each comprising:

a frame defining two cavities;

an eye plate upon the frame and having first and second regions;

first and second light sources, each received in one of the two cavities and oriented to separately illuminate at least the respective first and second regions; and a control system in electrical communication with the first and second light sources and having a method to operate the first and second light sources in a blinking sequence displayed on the first and second regions comprising:

activating the first and second light sources of each of the first and second assemblies;

deactivating the first light sources of each of the first and second assemblies;

deactivating the second light sources of each of the first and second assemblies;

activating the second light sources of each of the first and second assemblies; and activating the first light sources of each of the first and second assemblies.

16. The toy character of claim 15, wherein each of the first and second assemblies further comprises a graphic layer upon the eye plate with indicia indicative of an eye design.

17. The toy character of claim 15, further comprising a plurality of appendages secured to the body for movement relative thereto; and a plurality of actuators oriented in the body, each in cooperation with one of the plurality of appendages, wherein the control system is in electrical communication with the plurality of actuators, and is further configured to operate the actuators to actuate the appendages.

18. The toy character of claim 15, further comprising a sensor in electrical communication with the control system, wherein the control system is further configured to receive an input signal from the sensor, and to activate one or more illumination sequences of the first and second light sources in response to the input signal from the sensor.

19. The toy character of claim 15, wherein each frame of the first and second eye assemblies further comprises a plurality of segments formed with a thickness such that a portion of the respective eye plate adjacent the plurality of segments receives a sufficient amount of light to prevent visibility of the plurality of segments.

* * * * *